US010518389B2

(12) United States Patent
Liu et al.

(10) Patent No.: US 10,518,389 B2
(45) Date of Patent: Dec. 31, 2019

(54) DEVICE FOR REMOVING BURRS FROM FLANGE FACE OF WHEEL

(71) Applicant: CITIC Dicastal CO., LTD., Qinhuangdao, Hebei (CN)

(72) Inventors: Huiying Liu, Qinhuangdao (CN); Dong Guo, Qinhuangdao (CN)

(73) Assignee: CITIC Dicastal CO., LTD., Qinhuangdao, Hebei (CN)

( * ) Notice: Subject to any disclaimer, the term of this patent is extended or adjusted under 35 U.S.C. 154(b) by 204 days.

(21) Appl. No.: 15/887,141

(22) Filed: Feb. 2, 2018

(65) Prior Publication Data

US 2019/0202034 A1 Jul. 4, 2019

(30) Foreign Application Priority Data

Dec. 29, 2017 (CN) ..... 2017 1 1469660

(51) Int. Cl.

| | |
|---|---|
| ***B24D 13/14*** | (2006.01) |
| ***B08B 1/00*** | (2006.01) |
| ***B24B 19/26*** | (2006.01) |
| ***B24B 29/00*** | (2006.01) |

(52) U.S. Cl.

CPC ..... *B24D 13/145* (2013.01); *B08B 1/002* (2013.01); *B24B 19/26* (2013.01); *B24B 29/005* (2013.01)

(58) Field of Classification Search

CPC ..... B24D 13/145; B08B 1/002; B24B 19/26; B24B 29/005; B24B 27/003; B24B 27/0076; B24B 27/0061; B24B 29/04; B24B 5/44; B24B 5/40; B24B 5/08; B23C 3/12; B23C 3/122; B23C 2215/085; B23C 2220/20; B23C 2220/16; B23C 2220/68

See application file for complete search history.

(56) References Cited

U.S. PATENT DOCUMENTS

| | | | | |
|---|---|---|---|---|
| 9,833,873 | B2 * | 12/2017 | Xue | B24B 29/005 |
| 10,279,433 | B2 * | 5/2019 | Luo | B23K 37/0426 |
| 2016/0354891 | A1 * | 12/2016 | Xue | B24B 5/44 |
| 2017/0182616 | A1 * | 6/2017 | Xue | B24B 9/04 |
| 2017/0182617 | A1 * | 6/2017 | Xue | B24B 9/04 |
| 2017/0209976 | A1 * | 7/2017 | Xue | B24B 21/16 |

FOREIGN PATENT DOCUMENTS

| | | | |
|---|---|---|---|
| CN | 105598776 | A | 5/2016 |
| CN | 105881139 | A | 8/2016 |
| CN | 105945668 | A | 9/2016 |
| CN | 106964579 | A | 7/2017 |
| CN | 107030562 | A | 8/2017 |
| CN | 207682089 | U | 8/2018 |

* cited by examiner

*Primary Examiner* — Dung Van Nguyen

(74) *Attorney, Agent, or Firm* — Cooper Legal Group, LLC

(57) ABSTRACT

A device for removing burrs from a flange face of a wheel is composed of a frame, guide posts, a feeding cylinder, a lifting table, a servo motor I, a bolt hole soft brush I, a center support, a servo motor II, a bolt hole soft brush II, a center hole soft brush, a transverse chute, longitudinal chutes, drainage channel soft brushes and the like. The zigzag shape of the drainage channel soft brushes can be adjusted to match the shape of flange drainage channels by adjusting the positions of the movable shaft I, the movable shaft II), the movable shaft III, the movable shaft IV and the movable shaft V in the chutes.

1 Claim, 7 Drawing Sheets

DEVICE FOR REMOVING BURRS FROM FLANGE FACE OF WHEEL

CROSS-REFERENCE TO RELATED APPLICATIONS

This application is filed based upon and claims priority to Chinese Patent Application No. 201711469660.4, filed on Dec. 29, 2017, the entire contents of which are incorporated herein by reference.

BACKGROUND

After wheel machining, there are mainly three kinds of burrs on the flange part: the first kind of burrs are burrs around a flange drainage channel, this position is a casting and machining joint area, and the flange drainage channel is diverse in shape, so the burrs here are difficult to remove. The second kind of burrs are bolt hole chamfer burrs, and after the backs of bolt holes are chamfered, tiny burrs may be left at the edges and also need to be removed in time. The third kind of burrs are burrs at the opening of the joint of the drainage channel and the center hole, and the burrs therein are hidden and irregular, so it is difficult to remove the burrs. If the burrs at the three positions of the flange are not removed thoroughly, not only is the detection on flatness and position affected, but also the flange face is uneven to fit during loading, leading to customer complaints, so the burrs must be cleaned thoroughly. Based on the current situation, the present patent provides a device for automatically removing burrs from a flange face of a wheel, which can thoroughly remove burrs in all directions and multiple angles.

SUMMARY

The disclosure relates to the technical field of flange burr cleaning after wheel machining, and specifically, to a device for automatically removing burrs from flange drainage channels, bolt hole chamfers and a center hole edge of a wheel.

A device for removing burrs from a flange face of a wheel is provided, which can be used for automatic continuous production, remove burrs in all directions and multiple angles, improve the burr removing effect and solve the problem of burr residue. The device has the characteristics of advanced process, high stability and efficiency, strong universality and the like.

In one embodiment of the disclosure, a device for removing burrs from a flange face of a wheel is composed of a frame, guide posts, a feeding cylinder, a lifting table, guide sleeves, an adjusting guide rail I, a left sliding block, an adjusting cylinder I, a right sliding block, a gear rack I, an adjusting guide rail II, an adjusting cylinder II, an adjusting cylinder III, an adjusting sliding block, a servo motor I, a bolt hole soft brush I, a center support, a servo motor II, a bolt hole soft brush II, a center hole soft brush, a transverse chute, longitudinal chutes, a bearing I, a fixed shaft, a chain wheel I, a servo motor III, a chain wheel II, a fixed belt pulley, a movable shaft I, a movable shaft II, a movable shaft III, a movable shaft IV, a movable shaft V, sleeves, bearings II, slides, lock nuts, a drive belt, drainage channel soft brushes, a support frame, a clamping guide rail, a clamping cylinder, a rotating drive motor, a left sliding plate, a clamping wheel, a right sliding plate and a gear rack II.

The support frame is fixed on the frame, the clamping guide rail is fixed on the support frame, the left sliding plate and the right sliding plate are symmetrically mounted on the clamping guide rail and connected with each other via the gear rack II, the clamping cylinder is fixed on the side of the frame, the output end of the clamping cylinder is connected with the left sliding plate, the rotating drive motor is mounted on the left sliding plate, and the clamping wheel is mounted at the output end of the motor. The clamping cylinder is started, the left sliding plate and the right sliding plate move synchronously under the action of the gear rack II, the wheel can be positioned and clamped by using the clamping wheel, and the rotating drive motor is started to drive the wheel to rotate at a low speed in the clamped state.

The feeding cylinder and the four guide posts are fixed below the frame, and the output end of the feeding cylinder is connected with the lifting table to control the lifting table to ascend and descend under the guidance of the guide posts. The center support is mounted at the center of the lifting table, the servo motor II is fixed on the center support, the center hole soft brush for removing burrs from the edge of a center hole is mounted at the output end of the motor, and the center hole soft brush is conical and can be used for removing burrs from center holes having different diameters.

The adjusting cylinder II is mounted on the rear side of the lifting table via a support, the adjusting cylinder III is mounted on the front side of the lifting table via a support, and the adjusting cylinder II and the adjusting cylinder III are symmetric in front and back about the center support. The output end of the adjusting cylinder II is connected with the adjusting sliding block, the adjusting sliding block is mounted on the adjusting guide rail II, the servo motor I is mounted on the adjusting sliding block, and the bolt hole soft brush I is mounted at the output end of the servo motor I. The connection structure of the adjusting cylinder III is same as that of the adjusting cylinder II. The bolt hole soft brush I and the bolt hole soft brush II are symmetric about the center hole soft brush. The distance between the bolt hole soft brush I and the bolt hole soft brush II can be adjusted via the adjusting cylinder II and the adjusting cylinder III to match different bolt hole pitch diameters, so that the device can be used for removing burrs from bolt hole chamfers having different pitch diameters.

The adjusting guide rail I is fixed on the lifting table, the left sliding block and the right sliding block are symmetrically mounted on the adjusting guide rail I and connected with each other via the gear rack I, and the left sliding block and the right sliding block are bilaterally symmetric about the center support. The adjusting cylinder I is fixed on the lifting table via a support, the output end of the adjusting cylinder I is connected with the right sliding block, the distance between the left sliding block and the right sliding block can be adjusted via the adjusting cylinder I, and the brush structure settings on the left sliding block and the right sliding block are completely identical. One transverse chute and two longitudinal chutes are formed in the upper end face of the left sliding block, the servo motor III is fixed on the upper end face of the left sliding block, the output end of the servo motor III is connected with the chain wheel I, the chain wheel I is connected with the chain wheel II via a chain, the chain wheel II is fixed on the fixed shaft, the lower end of the fixed shaft is mounted on the left sliding block via the bearing I, and the fixed belt pulley is mounted at the upper end of the fixed shaft. The servo motor III drives the chain wheel I to move, and the fixed shaft can be driven to rotate. The movable shaft I, the movable shaft II, the movable shaft III, the movable shaft IV and the movable shaft V are same in structure, a slide for matching the chute is arranged at the lower end of each of them, the movable shaft I, the movable shaft II, the movable shaft III and the movable shaft IV are mounted in the longitudinal chutes, and the movable shaft V is mounted in the transverse chute. The positions of the movable shafts in the chutes can be fixed via the lock nuts, a bearing II is mounted at the upper end of each movable shaft, a sleeve is mounted outside the bearing II, a groove is formed in the outer wall of the sleeve, the drive belt is mounted on a closed loop formed by the fixed belt pulley and the five sleeves, and the drainage channel soft brushes are mounted above the drive belt. When the servo motor III drives the fixed belt pulley to rotate, the drive belt can be driven to move in a zigzag manner, and the drainage channel soft brushes can thus be driven to move in a zigzag manner to remove burrs from flange drainage channels. The zigzag shape of the drainage channel soft brushes can be adjusted to match the shape of the flange drainage channels by adjusting the positions of the movable shaft I, the movable shaft II, the movable shaft III, the movable shaft IV and the movable shaft V in the chutes, so that the drainage channel soft brushes can be used for removing burrs from different flange drainage channel structures, and the burr removing effect is better. The distance between the left and right drainage channel soft brushes can be adjusted by adjusting the distance between the left sliding block and the right sliding block, so that the drainage channel soft brushes can be used for removing burrs from drainage channels having different flange diameters.

The working process of the device is: firstly, the clamping cylinder is started, the left sliding plate and the right sliding plate move synchronously under the action of the gear rack II, the clamping wheel positions and clamps a wheel, and the rotating drive motor is started to drive the wheel to rotate at a low speed in the clamped state; then, the feeding cylinder is started to drive the bolt hole soft brush I, the bolt hole soft brush II, the center hole soft brush and the drainage channel soft brushes to arrive at a flange face of the wheel; next, the servo motor I, the servo motor II and the servo motor III are synchronously driven to drive the soft brushes to rotate, and the brushes are subjected to brushing force of multiple directions and angles via rotation of the brushes and relative movement of the wheel and the brushes, so that burrs can be removed in all directions and multiple angles; and after the wheel rotates one cycle at the low speed, burrs can be removed from all drainage channels, bolt hole chamfers and center hole corners.

The device of the disclosure can remove burrs from a flange face of a wheel in all directions and multiple angles, can be used for automatic continuous production, improves the burr removing effect, solves the problem of burr residue at flange drainage channels, bolt hole chamfers and the edge of a center hole, and is advanced, stable, efficient and strong in universality.

Figure 1:
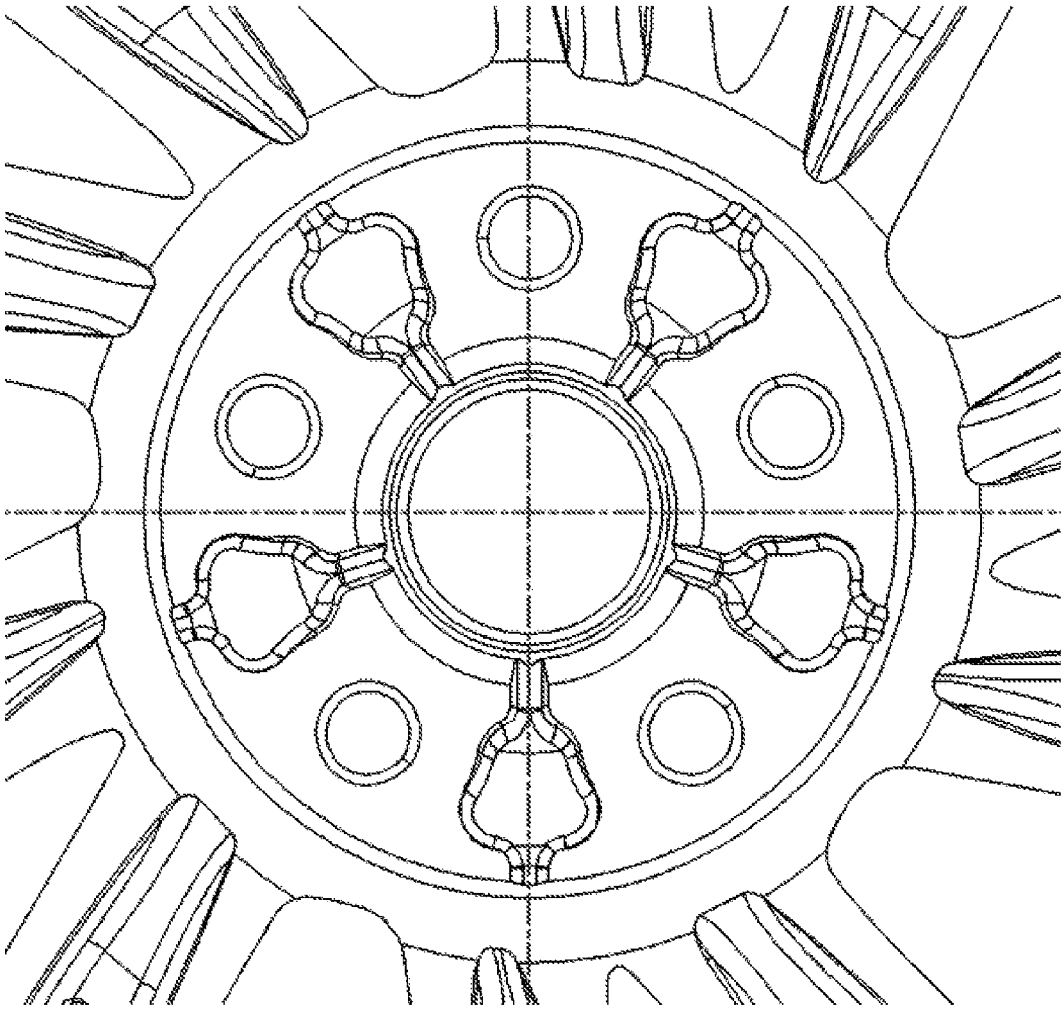
FIG. 1 is a schematic diagram of a burr part of a wheel flange face.
Figure 2:
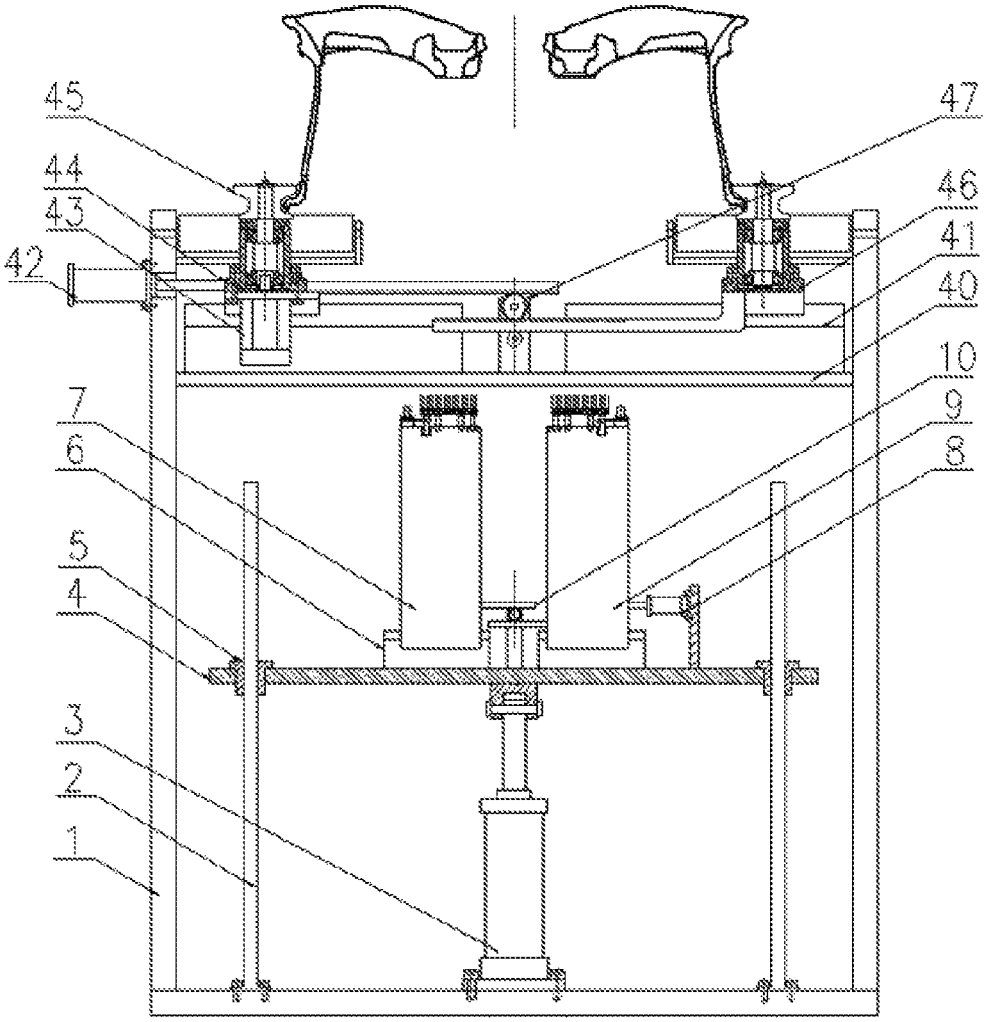
FIG. 2 is a front view of a device for removing burrs from a flange face of a wheel in the disclosure.
Figure 3:
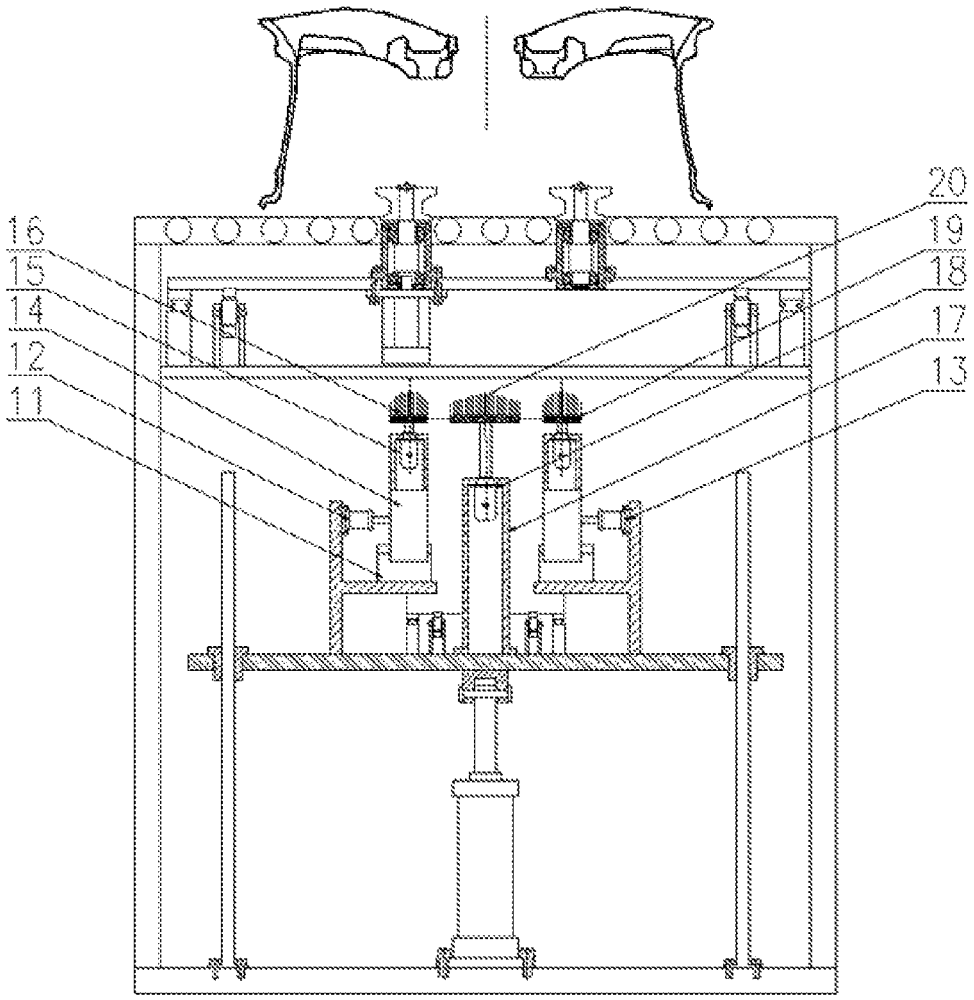
FIG. 3 is a left view of the device for removing burrs from the flange face of the wheel in the disclosure.
Figure 4:
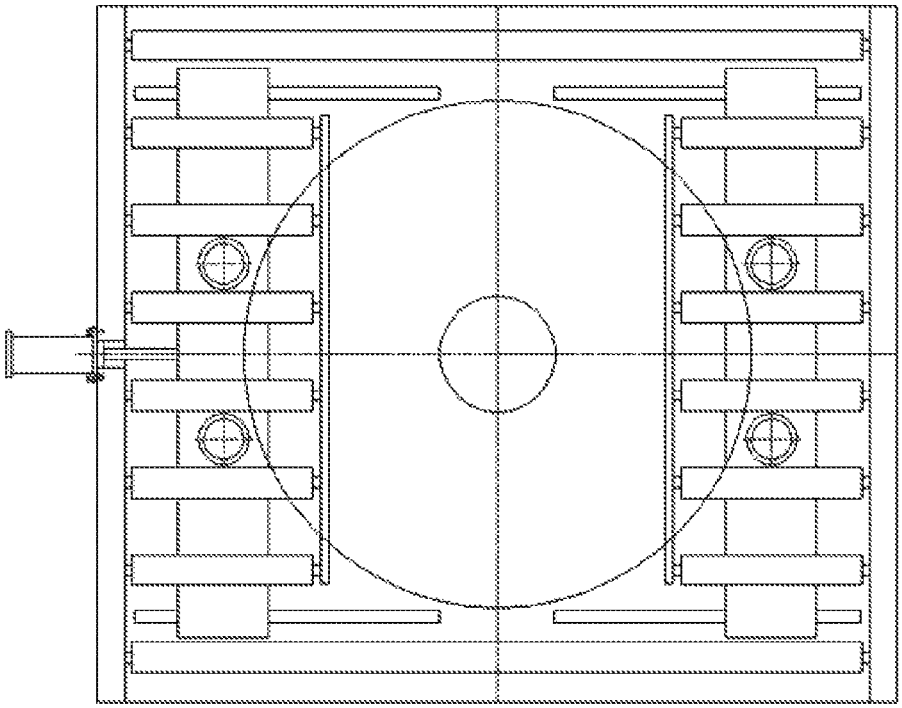
FIG. 4 is a top view of the device for removing burrs from the flange face of the wheel in the disclosure.
Figure 5:
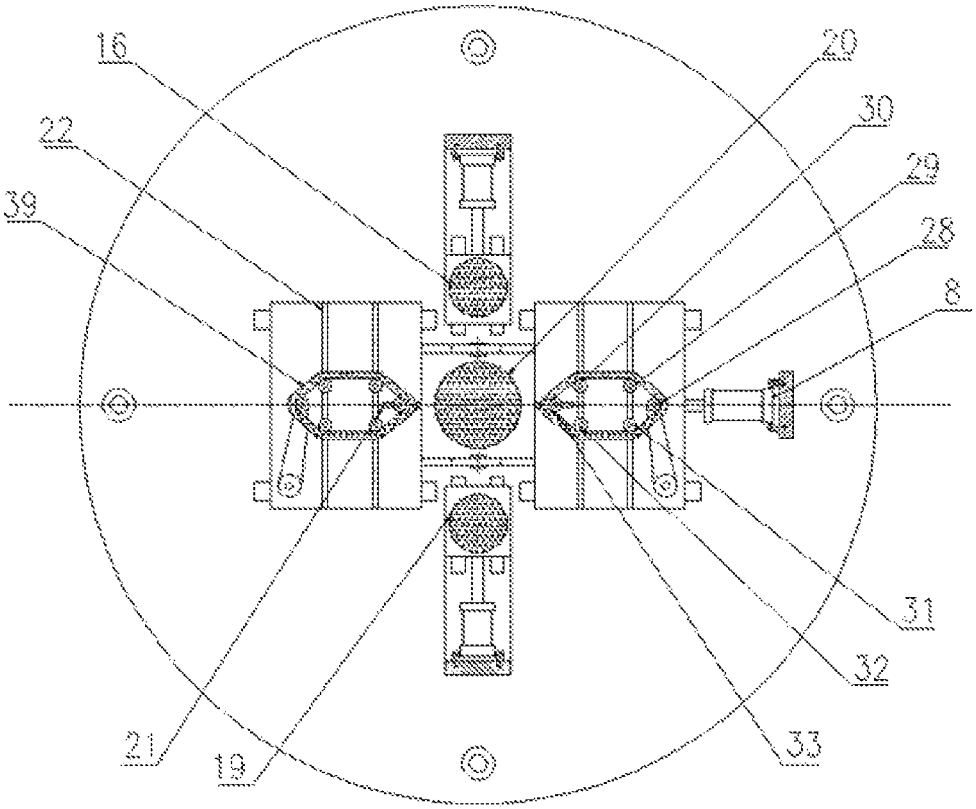
FIG. 5 is a top view of a brush system of the device for removing burrs from the flange face of the wheel in the disclosure.
Figure 6:
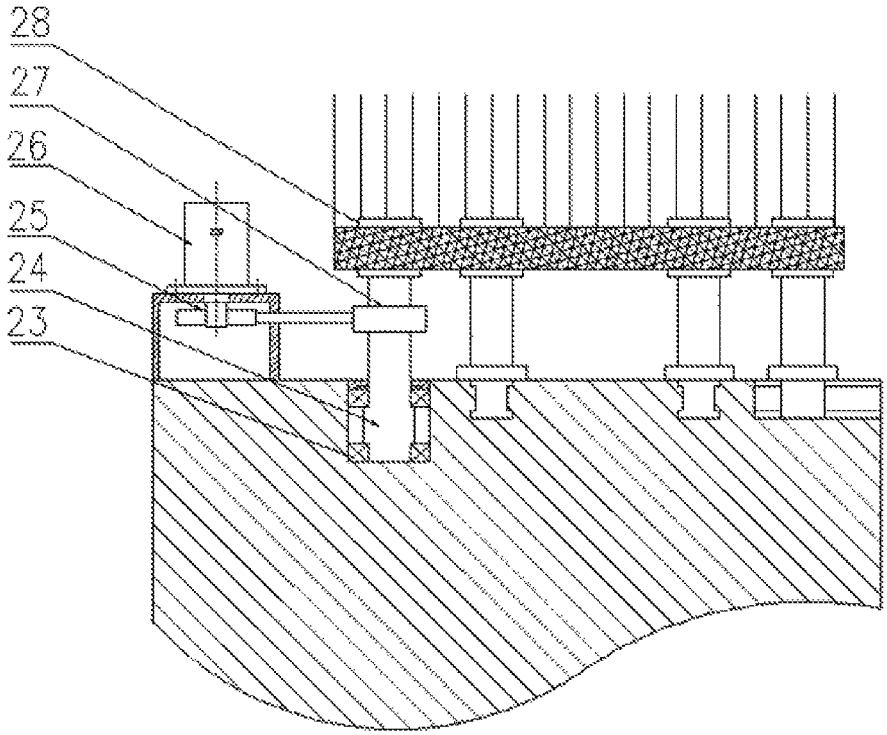
FIG. 6 is a structural diagram of a drainage channel soft brush of the device for removing burrs from the flange face of the wheel in the disclosure.
Figure 7:
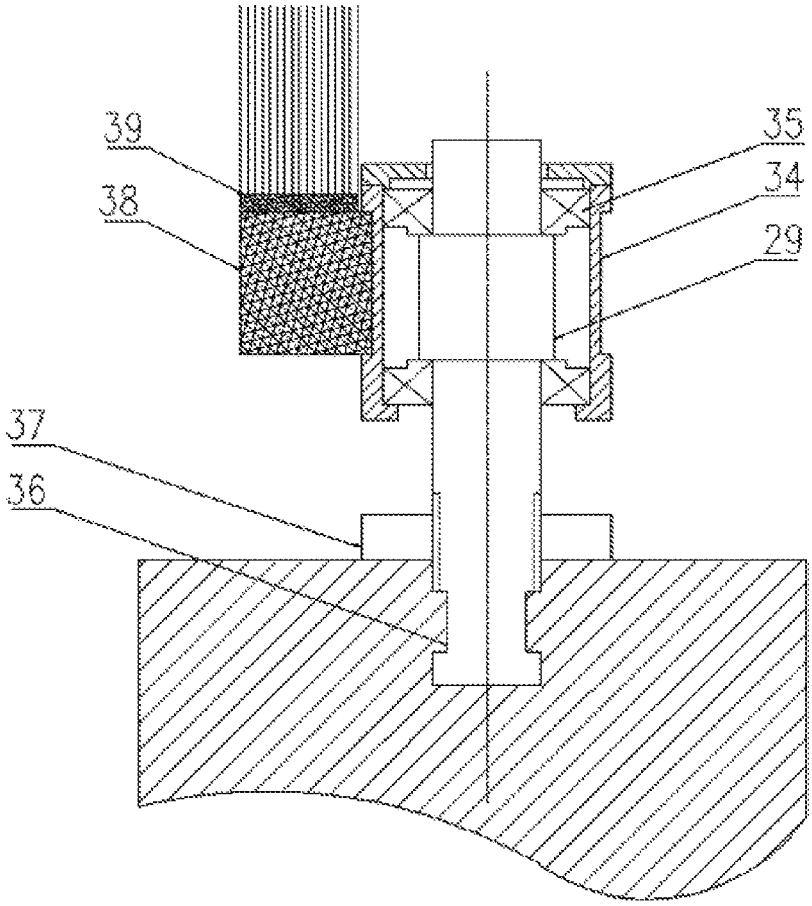
FIG. 7 is a structural diagram of a movable shaft I of the device for removing burrs from the flange face of the wheel in the disclosure.

In which, 1—frame, 2—guide post, 3—feeding cylinder, 4—lifting table, 5—guide sleeve, 6—adjusting guide rail I, 7—left sliding block, 8—adjusting cylinder I, 9—right sliding block, 10—gear rack I, 11—adjusting guide rail II, 12—adjusting cylinder II, 13—adjusting cylinder III, 14—adjusting sliding block, 15—servo motor I, 16—bolt hole soft brush I, 17—center support, 18—servo motor II, 19—bolt hole soft brush II, 20—center hole soft brush, 21—transverse chute, 22—longitudinal chute, 23—bearing I, 24—fixed shaft, 25—chain wheel I, 26—servo motor III, 27—chain wheel II, 28—fixed belt pulley, 29—movable shaft I, 30—movable shaft II, 31—movable shaft III, 32—movable shaft IV, 33—movable shaft V, 34—sleeve, 35—bearing II, 36—slide, 37—lock nut, 38—drive belt, 39—drainage channel soft brush, 40—support frame, 41—clamping guide rail, 42—clamping cylinder, 43—rotating drive motor, 44—left sliding plate, 45—clamping wheel, 46—right sliding plate, 47—gear rack II.

DETAILED DESCRIPTION

Specific details and working conditions of a device provided by the disclosure will be given below in combination with the accompanying drawings.

A device for removing burrs from a flange face of a wheel is composed of a frame 1, guide posts 2, a feeding cylinder 3, a lifting table 4, guide sleeves 5, an adjusting guide rail I 6, a left sliding block 7, an adjusting cylinder I 8, a right sliding block 9, a gear rack I 10, an adjusting guide rail II 11, an adjusting cylinder II 12, an adjusting cylinder III 13, an adjusting sliding block 14, a servo motor I 15, a bolt hole soft brush I 16, a center support 17, a servo motor II 18, a bolt hole soft brush II 19, a center hole soft brush 20, a transverse chute 21, longitudinal chutes 22, a bearing I 23, a fixed shaft 24, a chain wheel I 25, a servo motor III 26, a chain wheel II 27, a fixed belt pulley 28, a movable shaft I 29, a movable shaft II 30, a movable shaft III 31, a movable shaft IV 32, a movable shaft V 33, sleeves 34, bearings II 35, slides 36, lock nuts 37, a drive belt 38, drainage channel soft brushes 39, a support frame 40, a clamping guide rail 41, a clamping cylinder 42, a rotating drive motor 43, a left sliding plate 44, a clamping wheel 45, a right sliding plate 46 and a gear rack II 47.

The support frame 40 is fixed on the frame 1, the clamping guide rail 41 is fixed on the support frame 40, the left sliding plate 44 and the right sliding plate 46 are symmetrically mounted on the clamping guide rail 41 and connected with each other via the gear rack II 47, the clamping cylinder 42 is fixed on the side of the frame 1, the output end of the clamping cylinder 42 is connected with the left sliding plate 44, the rotating drive motor 43 is mounted on the left sliding plate 44, and the clamping wheel 45 is mounted at the output end of the motor. The clamping cylinder 42 is started, the left sliding plate 44 and the right sliding plate 46 move synchronously under the action of the gear rack II 47, the wheel can be positioned and clamped by using the clamping wheel 45, and the rotating drive motor 43 is started to drive the wheel to rotate at a low speed in the clamped state.

The feeding cylinder 3 and the four guide posts 2 are fixed below the frame 1, and the output end of the feeding cylinder 3 is connected with the lifting table 4 to control the lifting table 4 to ascend and descend under the guidance of the guide posts 2. The center support 17 is mounted at the center of the lifting table 4, the servo motor II 18 is fixed on the center support 17, the center hole soft brush 20 for removing burrs from the edge of a center hole is mounted at the output end of the motor, and the center hole soft brush 20 is conical and can be used for removing burrs from center holes having different diameters.

The adjusting cylinder II 12 is mounted on the rear side of the lifting table 4 via a support, the adjusting cylinder III 13 is mounted on the front side of the lifting table 4 via a support, and the adjusting cylinder II 12 and the adjusting cylinder III 13 are symmetric in front and back about the center support 17. The output end of the adjusting cylinder II 12 is connected with the adjusting sliding block 14, the adjusting sliding block 14 is mounted on the adjusting guide rail II 11, the servo motor I 15 is mounted on the adjusting sliding block 14, and the bolt hole soft brush I 16 is mounted at the output end of the servo motor I 15. The connection structure of the adjusting cylinder III 13 is same as that of the adjusting cylinder II 12. The bolt hole soft brush I 16 and the bolt hole soft brush II 19 are symmetric about the center hole soft brush 20. The distance between the bolt hole soft brush I 16 and the bolt hole soft brush II 19 can be adjusted via the adjusting cylinder II 12 and the adjusting cylinder III 13 to match different bolt hole pitch diameters, so that the device can be used for removing burrs from bolt hole chamfers having different pitch diameters.

The adjusting guide rail I 6 is fixed on the lifting table 4, the left sliding block 7 and the right sliding block 9 are symmetrically mounted on the adjusting guide rail I 6 and connected with each other via the gear rack I 10, and the left sliding block 7 and the right sliding block 9 are bilaterally symmetric about the center support 17. The adjusting cylinder I 8 is fixed on the lifting table 4 via a support, the output end of the adjusting cylinder I 8 is connected with the right sliding block 9, the distance between the left sliding block 7 and the right sliding block 9 can be adjusted via the adjusting cylinder I 8, and the brush structure settings on the left sliding block 7 and the right sliding block 9 are completely identical. One transverse chute 21 and two longitudinal chutes 22 are formed in the upper end face of the left sliding block 7, the servo motor III 26 is fixed on the upper end face of the left sliding block 7, the output end of the servo motor III 26 is connected with the chain wheel I 25, the chain wheel I 25 is connected with the chain wheel II 27 via a chain, the chain wheel II 27 is fixed on the fixed shaft 24, the lower end of the fixed shaft 24 is mounted on the left sliding block 7 via the bearing I 23, and the fixed belt pulley 28 is mounted at the upper end of the fixed shaft 24. The servo motor III 26 drives the chain wheel I 25 to move, and the fixed shaft 24 can be driven to rotate. The movable shaft I 29, the movable shaft II 30, the movable shaft III 31, the movable shaft IV 32 and the movable shaft V 33 are same in structure, a slide 36 for matching the chute is arranged at the lower end of each of them, the movable shaft I 29, the movable shaft II 30, the movable shaft III 31 and the movable shaft IV 32 are mounted in the longitudinal chutes 22, and the movable shaft V 33 is mounted in the transverse chute 21. The positions of the movable shafts in the chutes can be fixed via the lock nuts 37, a bearing II 35 is mounted at the upper end of each movable shaft, a sleeve 34 is mounted outside the bearing II 35, a groove is formed in the outer wall of the sleeve 34, the drive belt 38 is mounted on a closed loop formed by the fixed belt pulley 28 and the five sleeves 34, and the drainage channel soft brushes 39 are mounted above the drive belt 38. When the servo motor III 26 drives the fixed belt pulley 28 to rotate, the drive belt 38 can be driven to move in a zigzag manner, and the drainage channel soft brushes 39 can thus be driven to move in a zigzag manner to remove burrs from flange drainage channels. The zigzag shape of the drainage channel soft brushes 39 can be adjusted to match the shape of the flange drainage channels by adjusting the positions of the movable shaft I 29, the movable shaft II 30, the movable shaft III 31, the movable shaft IV 32 and the movable shaft V 33 in the chutes, so that the drainage channel soft brushes 39 can be used for removing burrs from different flange drainage channel structures, and the burr removing effect is better. The distance between the left and right drainage channel soft brushes 39 can be adjusted by adjusting the distance between the left sliding block 7 and the right sliding block 9, so that the drainage channel soft brushes 39 can be used for removing burrs from drainage channels having different flange diameters.

The working process of the device is: firstly, the clamping cylinder 42 is started, the left sliding plate 44 and the right sliding plate 46 move synchronously under the action of the gear rack II 47, the clamping wheel 45 positions and clamps a wheel, and the rotating drive motor 43 is started to drive the wheel to rotate at a low speed in the clamped state; then, the feeding cylinder 3 is started to drive the bolt hole soft brush I 16, the bolt hole soft brush II 19, the center hole soft brush 20 and the drainage channel soft brushes 39 to arrive at a flange face of the wheel; next, the servo motor I 15, the servo motor II 18 and the servo motor III 26 are synchronously driven to drive the soft brushes to rotate, and the brushes are subjected to brushing force of multiple directions and angles via rotation of the brushes and relative movement of the wheel and the brushes, so that burrs can be removed in all directions and multiple angles; and after the wheel rotates one cycle at the low speed, burrs can be removed from all drainage channels, bolt hole chamfers and center hole corners.

The device of the disclosure can remove burrs from a flange face of a wheel in all directions and multiple angles, can be used for automatic continuous production, improves the burr removing effect, solves the problem of burr residue at flange drainage channels, bolt hole chamfers and the edge of a center hole, and is advanced, stable, efficient and strong in universality.

The invention claimed is:

1. A device for removing burrs from a flange face of a wheel, the device being composed of a frame, guide posts, a feeding cylinder, a lifting table, guide sleeves, an adjusting guide rail I, a left sliding block, an adjusting cylinder I, a right sliding block, a gear rack I, an adjusting guide rail II, an adjusting cylinder II, an adjusting cylinder III, an adjusting sliding block, a servo motor I, a bolt hole soft brush I, a center support, a servo motor II, a bolt hole soft brush II, a center hole soft brush, a transverse chute, longitudinal chutes, a bearing I, a fixed shaft, a chain wheel I, a servo motor III, a chain wheel II, a fixed belt pulley, a movable shaft I, a movable shaft II, a movable shaft III, a movable shaft IV, a movable shaft V, sleeves, bearings II, slides, lock nuts, a drive belt, drainage channel soft brushes, a support frame, a clamping guide rail, a clamping cylinder, a rotating drive motor, a left sliding plate, a clamping wheel, a right sliding plate and a gear rack II, wherein the bolt hole soft brush I and the bolt hole soft brush II are symmetric about the center hole soft brush; the distance between the bolt hole soft brush I and the bolt hole soft brush II can be adjusted via the adjusting cylinder II and the adjusting cylinder III to match different bolt hole pitch diameters, so that the device can be used for removing burrs from bolt hole chamfers having different pitch diameters;

one transverse chute and two longitudinal chutes are formed in the upper end face of the left sliding block, the servo motor III drives the chain wheel I to move, and the fixed shaft can be driven to rotate; the movable shaft I, the movable shaft II, the movable shaft III, the movable shaft IV and the movable shaft V are same in structure, a slide for matching the chute is arranged at the lower end of each of them, the movable shaft I, the movable shaft II, the movable shaft III and the movable shaft IV are mounted in the longitudinal chutes, and the movable shaft V is mounted in the transverse chute; the positions of the movable shafts in the chutes can be fixed via the lock nuts, a bearing II is mounted at the upper end of each movable shaft, a sleeve is mounted outside the bearing II, a groove is formed in the outer wall of the sleeve, the drive belt is mounted on a closed loop formed by the fixed belt pulley and the five sleeves, and the drainage channel soft brushes are mounted above the drive belt; when the servo motor III drives the fixed belt pulley to rotate, the drive belt can be driven to move in a zigzag manner, and the drainage channel soft brushes can thus be driven to move in a zigzag manner to remove burrs from flange drainage channels; and the zigzag shape of the drainage channel soft brushes can be adjusted to match the shape of the flange drainage channels by adjusting the positions of the movable shaft I, the movable shaft II, the movable shaft III, the movable shaft IV and the movable shaft V in the chutes.

* * * * *